US006412671B1

(12) United States Patent
Riley et al.

(10) Patent No.: US 6,412,671 B1
(45) Date of Patent: Jul. 2, 2002

(54) SPRAY CAN SYSTEM AND TUBE HOLDER

(76) Inventors: Mary T. Riley; Michael J. Riley, both of 9102 Landry Blvd., Spring, TX (US) 77379

( * ) Notice: Subject to any disclaimer, the term of this patent is extended or adjusted under 35 U.S.C. 154(b) by 0 days.

(21) Appl. No.: 09/672,614

(22) Filed: Sep. 29, 2000

Related U.S. Application Data

(63) Continuation-in-part of application No. 09/268,840, filed on Mar. 16, 1999, now abandoned, which is a division of application No. 09/074,267, filed on May 7, 1998, now Pat. No. 6,102,258, which is a continuation-in-part of application No. 08/868,789, filed on Jun. 4, 1997, now Pat. No. 5,887,767.

(51) Int. Cl.[7] ..... B67D 3/00; B67D 5/06

(52) U.S. Cl. ..... 222/538; 222/402.1

(58) Field of Search ..... 222/402.1, 538, 222/543; 239/337, 587.1, 588

(56) References Cited

U.S. PATENT DOCUMENTS

| | | | | |
|---|---|---|---|---|
| 2,000,206 | A | 5/1935 | Yozewitch | |
| 2,145,142 | A | 1/1939 | Stout | |
| 3,199,751 | A | 8/1965 | Jovanovich | 222/543 |
| 3,445,033 | A | 5/1969 | Sweet et al. | 220/90.2 |
| 4,121,835 | A | 10/1978 | Garabedian | 239/33 X |
| 4,819,838 | A | 4/1989 | Hart, Jr. | 222/538 |
| 4,823,445 | A | 4/1989 | Diener | 24/326 |
| 4,858,792 | A | 8/1989 | deLaforcade | 222/533 |
| 5,018,635 | A | 5/1991 | Whittaker | 220/90.2 |
| 5,044,512 | A | 9/1991 | Giancaspro et al. | 220/90.2 |
| 5,048,709 | A | 9/1991 | Alverson | 220/90.2 |
| 5,058,783 | A | 10/1991 | Antonelli | 222/538 |
| D324,824 | S | 3/1992 | Hansen | D9/436 |
| 5,178,354 | A | 1/1993 | Engvall | 222/538 X |
| 5,253,393 | A | 10/1993 | Levin | 248/205.5 X |
| 5,297,704 | A | 3/1994 | Stollmeyer | 222/402.1 |
| 5,328,069 | A | 7/1994 | Cohanfard | 224/148 |
| 5,529,226 | A | 6/1996 | Alberth, Jr. | 222/534 |
| 5,544,783 | A | 8/1996 | Conigliaro | 270/735 |
| 5,788,129 | A | 8/1998 | Markos | 222/538 |
| 5,887,767 | A | 3/1999 | Riley et al. | 222/538 |
| 5,988,575 | A | 11/1999 | Lesko | 222/543 |

FOREIGN PATENT DOCUMENTS

| | | | |
|---|---|---|---|
| FR | 2381683 | 9/1978 | 222/538 |

*Primary Examiner*—Joseph A. Kaufman
(74) *Attorney, Agent, or Firm*—Guy McClung

(57) ABSTRACT

A spray can system, in certain embodiments, including a spray can with a hollow body with contents therein and gas under pressure for expelling the contents therefrom, and nozzle apparatus connected to the spray can and having a nozzle with a fluid flow channel therethrough with an exit port for the passage of the contents out from the spray can, a cap releasably emplaced on the hollow body for covering the nozzle apparatus, and a tube holder comprising a tube holder for holding a spray tube insertable into the nozzle, and the tube holder formed of the cap and separable therefrom or formed of a secondary member releasably connected to the cap or to the can, e.g. to a bottom portion or end thereof; and, in certain aspects, the tube holder further including a ring for encircling part of the spray can for mounting the tube holder to the spray can, an optional interconnection member having a first end and a second end, the first end connected to or formed integrally with the ring, and a holding member for holding the hollow spray tube and connected to or formed integrally with the second end of the interconnection member.

12 Claims, 12 Drawing Sheets

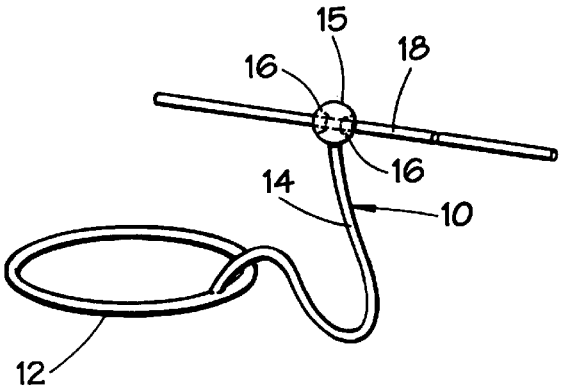
FIG.1A
FIG.1B
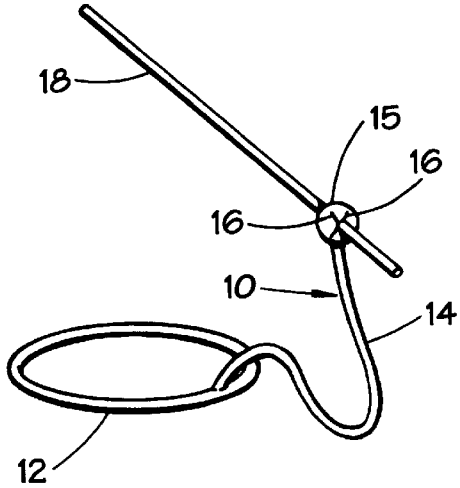
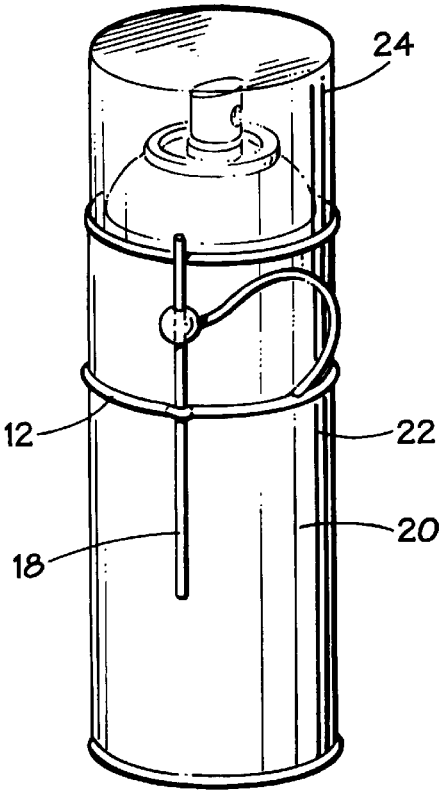
FIG.1C
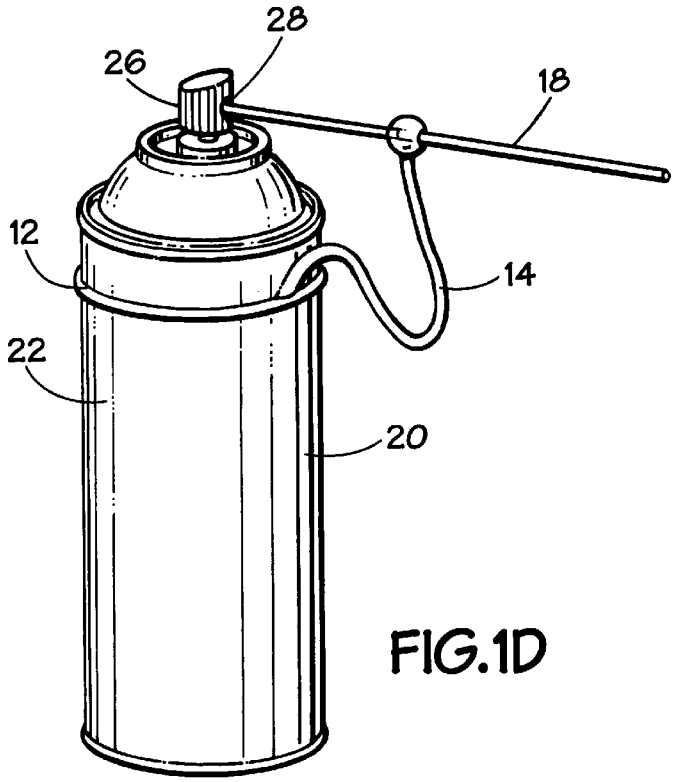
FIG.1D

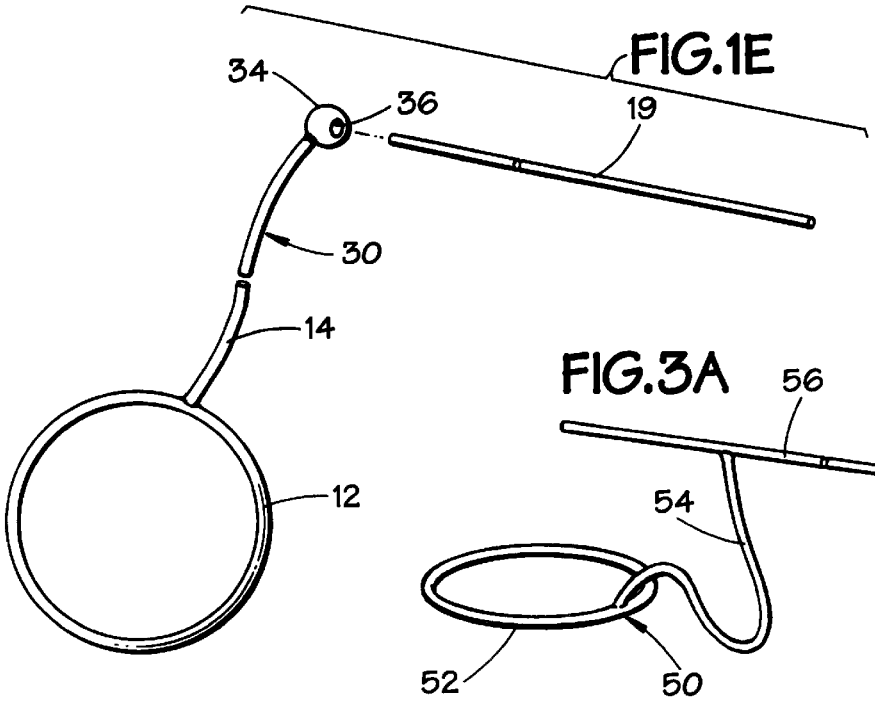
FIG.1E
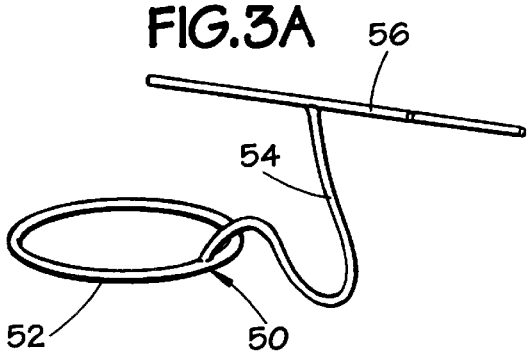
FIG.3A
FIG.2C
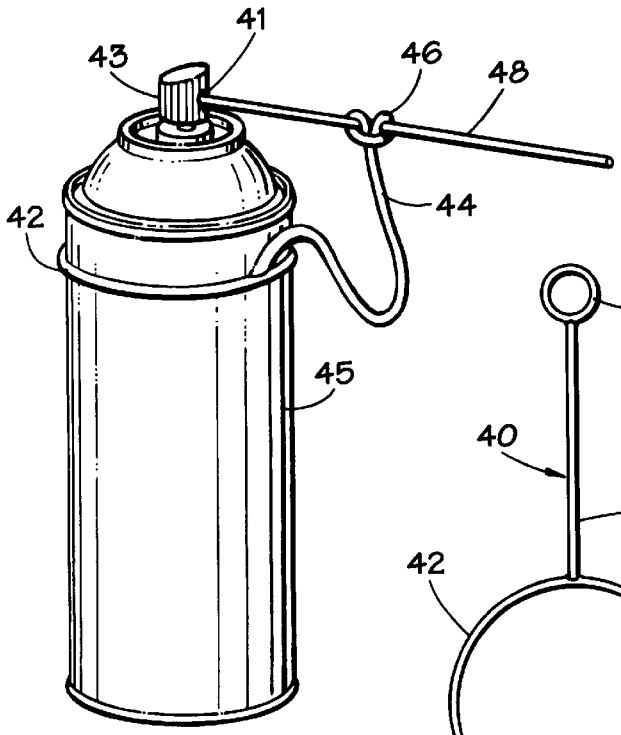
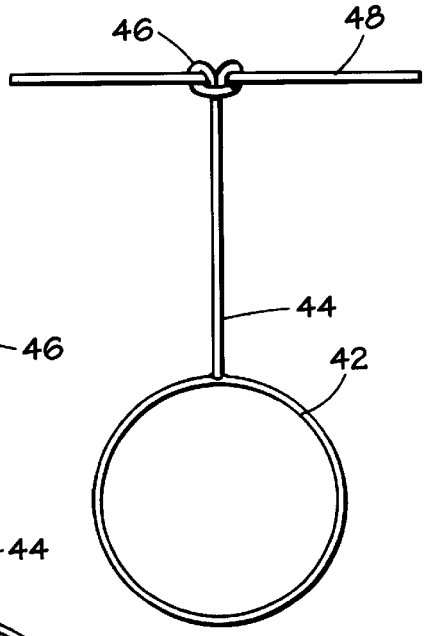
FIG.2B
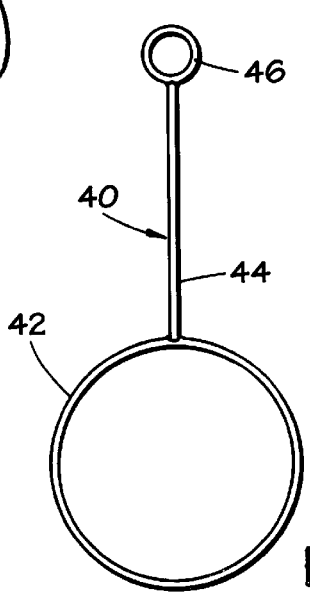
FIG.2A

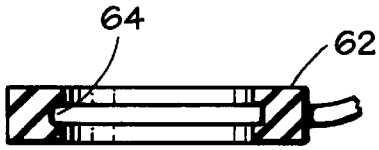
FIG.3D
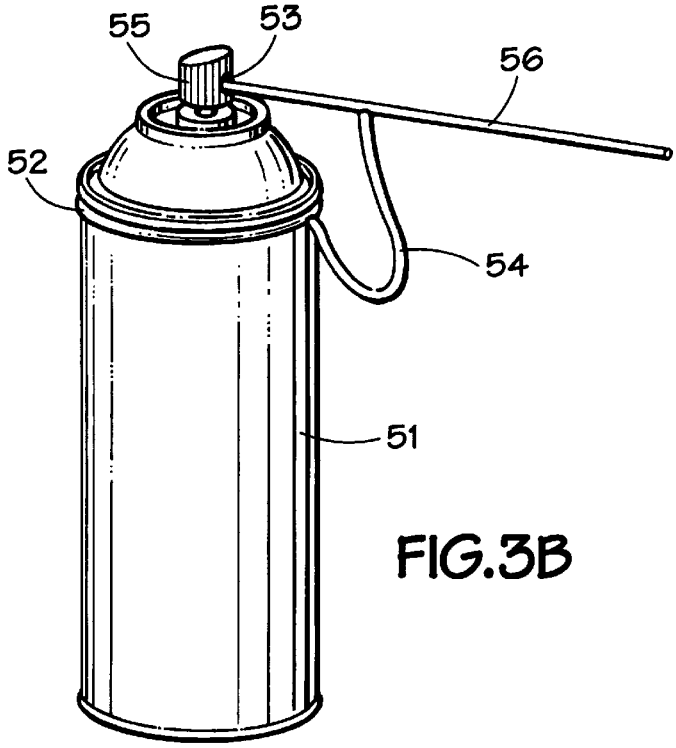
FIG.3B
FIG.4A
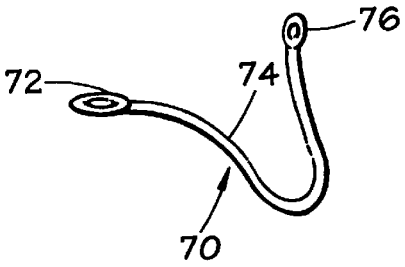
FIG.4C
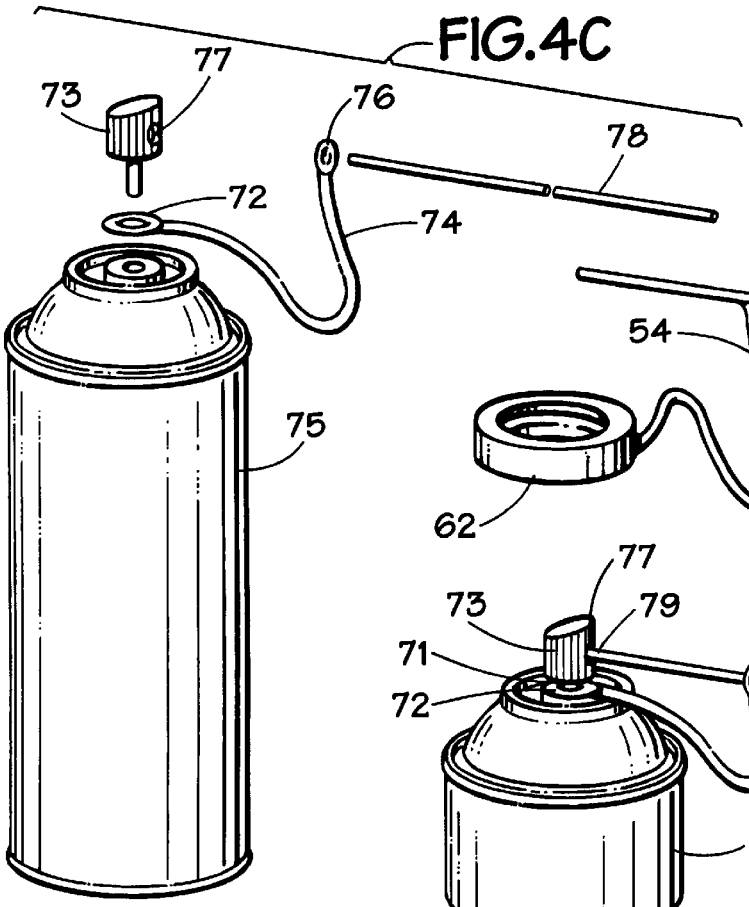
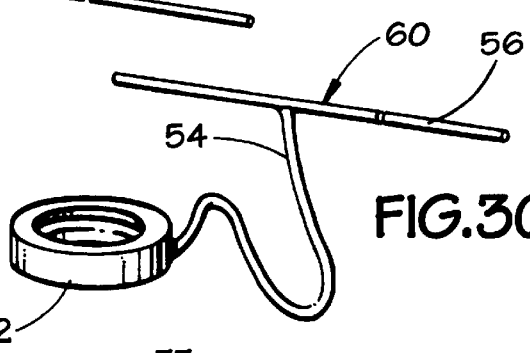
FIG.3C
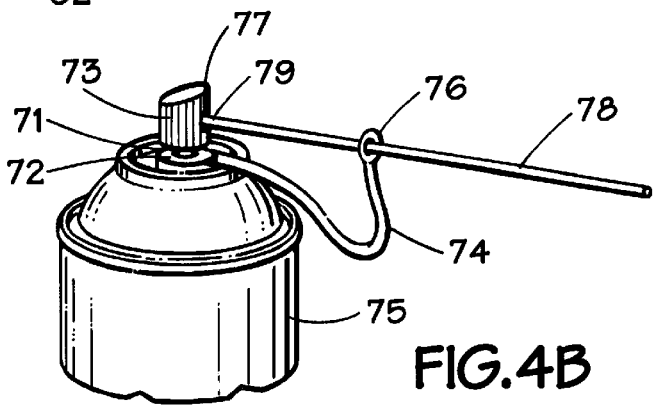
FIG.4B

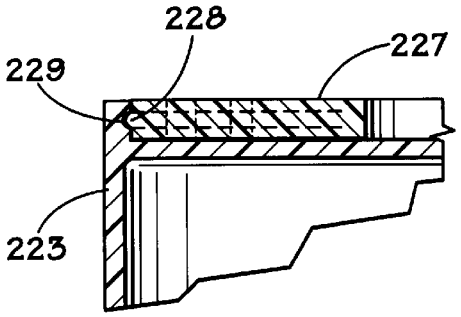
FIG. 20
FIG. 21
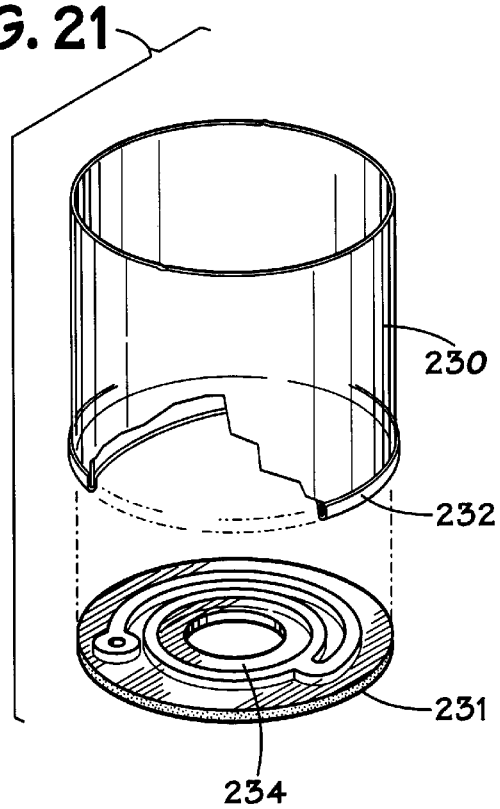
FIG. 22
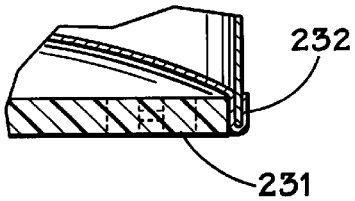
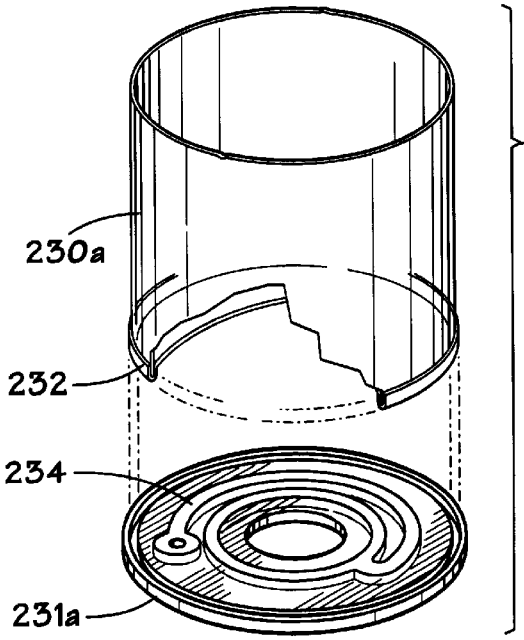
FIG. 23
FIG. 24
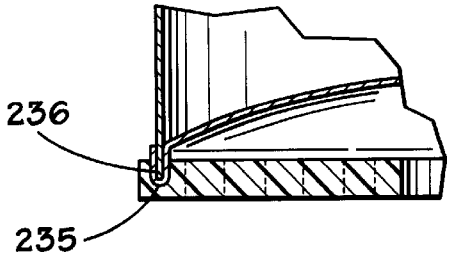

FIG. 25
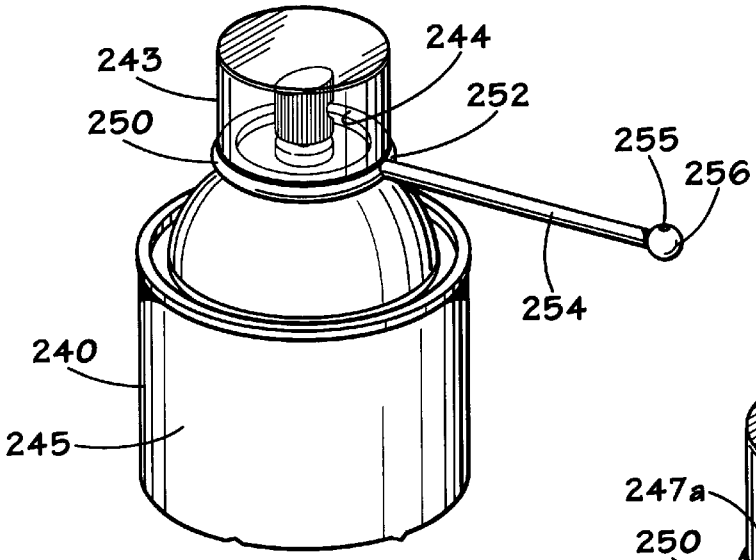
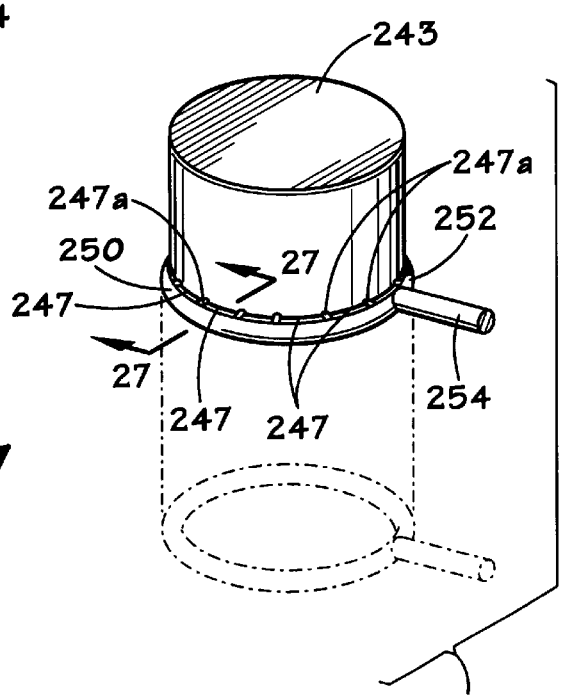
FIG. 26
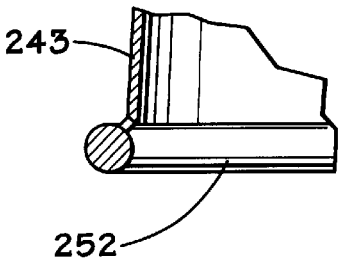
FIG. 27
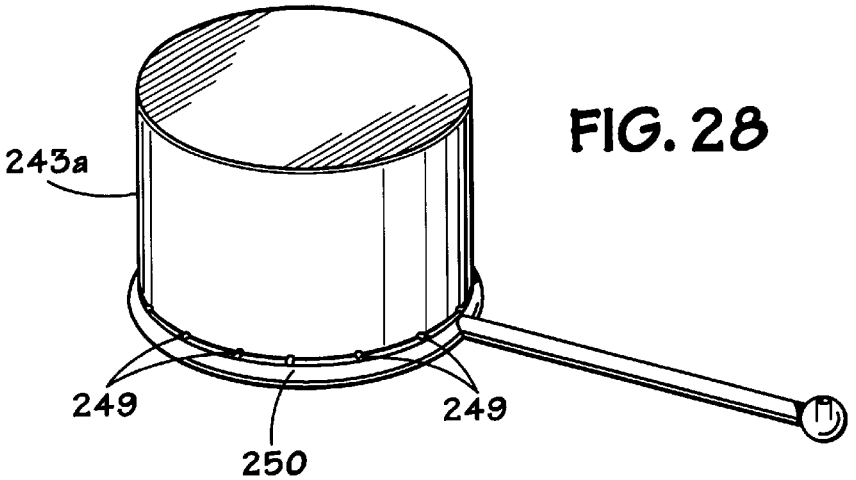
FIG. 28

SPRAY CAN SYSTEM AND TUBE HOLDER

RELATED APPLICATIONS

This is a continuation-in-part of U.S. Ser. No. 09/268,840 filed Mar. 16, 1999 now abandoned which is a division of U.S. Ser. No. 09/074,267 filed May 7, 1998 now U.S. Pat. No. 6,102,258 issued Aug. 15, 2000, which is a continuation-in-part of U.S. Ser. No. 08/868,789 filed Jun. 4, 1997 issued as U.S. Pat. No. 5,887,767 on Mar. 30, 1999, all co-owned herewith and incorporated here fully for all purposes.

BACKGROUND OF THE INVENTION

1. Field of the Invention

This invention is directed to spray or manual pump action containers with a nozzle into which a spray tube extender or spout is insertable; to a holder for such a spray tube; and to beverage containers with a drinking straw.

2. Description of Related Art

A wide variety of prior art spray containers, manual pump action containers, and aerosol-type spray cans have nozzles through which the container's contents is sprayed. With many of these containers, a hollow tube is provided which is insertable into the nozzle. Such tubes are used to focus a spray or to facilitate accurate direction of the spray to a specific part, area, or mechanism.

One common method of attaching a spray tube to a container is simply to use a piece of adhesive tape. Once the spray tube is released from the tape it is no longer connected to the container and is easily lost. For a person using a variety of containers with different contents and different size nozzles, it is important to have and use the correct spray tube for each container.

U.S. Pat. No. 5,058,783 discloses a spray container having a spray nozzle unit for outward discharge of fluid from the spray container that includes an elongated spray tube with a size and shape adapted for mounting onto the spray nozzle unit for guiding a spray of fluid discharged from the spray container and a spray tube support construction for use with the container that retains the spray tube adjacent the container. The support construction includes a support body and a holding element for holding the spray tube. A securing element affixes the support body to the spray container and a connected element affixes the holding element and the spray tube to the support body.

U.S. Pat. No. 4,823,445 discloses a clip for holding a spray tube on a spray can and a clip device that provides releasable retention of an accessory object to a primary object. The storage clip has a shaped clasp member having a jaw portion for secure engagement of a mounting strap, a body portion adjacent the jaw portion, a shoulder portion adjacent the body portion, and terminates in a tab portion adjacent the shoulder portion. The jaw, body, and shoulder portions are each configured to form an obtuse angle relative to its adjacent portion, and in the direction of said mounting strap, defining a void or cavity between the clasp member and the mounting strap. The terminating tab portion preferably forms an angle relative to the adjacent shoulder portion and away from the mounting strap, providing a manually engageable surface for lifting the clasp member away from the mounting strap.

U.S. Pat. No. 4,819,838 discloses a combined spray tube and support assembly for use with a spray container such as an aerosol can. The assembly has an elongated spray tube adapted for removable seating within a discharge port of a spray nozzle unit on the spray container. When separated from the spray nozzle unit, the spray tube is removably retained by a support member on the spray container or on a cap for the spray container. In one form, the support member has a vertically open support ring on the cap which cooperates with short outwardly projecting tabs near one end of the spray tube to support the spray tube alongside the spray container, with the tabs facilitating manipulation to seat the spray tube within the nozzle discharge port.

U.S. Pat. No. 5,544,783 discloses a clip-on device for removably holding a tube on an aerosol container, the device having a friction fit, flexible, circular clip-on-portion to be attached to a side wall of said aerosol container, the clip-on portion extending substantially but not completely around the sidewall portion as a C-shaped clip, so the clip-on portion can snugly engage the side wall; and two integral brackets, removably receiving by friction fit a tube or straw, each bracket formed by a pair of curved legs unitarily formed in one piece with the clip-on portion, the curved legs spaced on the clip portion and having a bridging segment of the clip portion between them.

U.S. Design Patent No. 324,824 discloses a combined vented closure for a container and a capped straw with a removable cap releasably held on a spout by an extended member with a ring that encircles the spout.

U.S. Pat. No. 5,044,512 discloses a sport bottle having a container for a liquid and a cover which seals to the container and which includes an aperture through which a straw extends outwardly from the cover to allow the user to drink from the container. A flexible handle element is secured to the cover and is disposed over the straw to allow the user to hold both the container and the straw. The handle element includes a cap for the straw so that the straw may be covered or closed when the sports bottle is not being used for drinking purposes. The cap prevents the liquid from sloshing out of the bottle and also prevents dirt, or the like, from entering through the straw and keeps the end of the straw or the portion of the straw which contacts the users lips, from accumulating dust, dirt, and the like.

U.S. Pat. No. 4,858,792 discloses a storage and dispensing unit with a container for product to be dispensed and a discharge conduit, a separate dispensing head with a part which is mountable on the container, and a pivotally mounted part including a push button and discharge applicator which has one end in communication with conduits formed internally of the push button so that when the push button is pivoted from a stored position to a dispensing position, the internal conduits of the push button are in communication with the discharge conduit of the container.

U.S. Pat. No. 5,328,069 discloses a beverage-container carrier and sipping assembly designed to replace the cap on a conventional bottle-type beverage container or to be directly attached to the circumferential edge of a sport bottle or an opened beverage can. The assembly has a dome shaped cover that has attached a carrying strap and a straw bore on its upper surface that accepts a drinking straw. The strap can be adjusted to an optimum length to hand carry the cover or to a length that allows the assembly to be placed around a person's neck or shoulders. In either case, the strap is attached to the container cover at points that correspond to the container shoulder or center-of-gravity. The container is comfortably balanced and supported when held by the strap. A vertically or horizontally oriented handle can be added to the cover to increase the assembly utility.

U.S. Pat. No. 5,048,709 discloses a straw-containing universal type cover assembly for a beverage container which includes a lid adapted to be snap fitted on an annular rim of the beverage container and is operative to simultaneously prevent spillage of and minimize decarbonation rates within the beverage once the container has been opened. The lid also includes a pull tab joined to the periphery thereof for both removing the lid from the beverage container and holding a straw in an upright position. The assembly further includes a multi-functional plug member attached to the straw by means of a flexible strap with a stem portion operative to be inserted into an opening in the lid in one orientation, with the lid opening being generally aligned with a sealed or previously sealed opening in the top of the beverage container. The plug member has an integral straw cap portion operative to fit in another orientation of the plug member over one end of the straw when the beverage container has been opened and the straw is not being used.

U.S. Pat. No. 3,445,033 discloses a container with a flexible drinking tube removably encircling the container within a flexible protective sheath.

U.S. Pat. No. 3,332,567 discloses a container with a groove or recess in which is removably positioned a drinking straw.

U.S. Pat. No. 5,018,635 discloses a fluid containment and access device for use with a beverage container having an upper, beaded rim and an opening for flow of the fluid contents from within the volume of the container includes a flexible lid, an integral straw and a vent with closure. The lid fits securely upon. the top of the beverage container to form a fluid-tight seal. The straw has a first end extending above the lid and a second end that extends through the opening substantially to the bottom of the container. The vent closure is moveable between a first position to permit the flow of air into the container and a second position to prevent the flow of air into the beverage container.

There has long been a need for an effective spray tube holder that is simple in construction, easy to manipulate, and which, in certain aspects, can accommodate a variety of different tubes, different containers, and different container parts.

SUMMARY OF THE PRESENT INVENTION

The present invention, in certain aspects, discloses a spray tube holder that has a first flexible portion for removable positioning on part of a container (including, but not limited to, around a main container body, around a body, around a rim on a body, around a nozzle, or between a removable nozzle and the body) and a second flexible portion interconnected with the first flexible portion for connection to or removable positioning around the spray tube.

In another aspect the second flexible portion is deleted and an interconnecting member extending from the first flexible portion is attached or adhered to the spray tube. In another aspect a tube retainer is connected to the first flexible portion, the tube retainer having a retainer body with an opening or with one or more slits through which the spray tube movably extends.

In another aspect the first flexible portion is deleted and a substantially rigid ring is used which fits snugly around any part of the container.

Tubes, straws and containers according to this invention may be made of any suitable material, including, but not limited to, any suitable metal, plastic or fiberglass.

The present invention also discloses a container including any of the tube holders disclosed herein. A drinking straw may be held by or be part of any tube holder disclosed herein (instead of a spray tube) and used with a beverage container instead of a spray container.

The present invention, in certain embodiments discloses a tube holder for holding drinking straw for a beverage container or a spray tube for a nozzle of a spray can, the holder including a ring for encircling part of the can or container to mount the holder thereto, an interconnection member with a first and a second end, the first end connected to or formed integrally with the ring, a holding member with a body and connected to or formed integrally with the second end, the body with at least one slit opening therethrough, the straw or spray tube insertable through and removably holdable in the slit opening(s); such a holder wherein the ring is stretchable material for positioning around the can or container; such a holder wherein the at least one slit opening is a plurality of intersecting openings; and such a holder further including the spray tube or straw.

The present invention discloses, in certain embodiments, a holder for holding a straw for a beverage container or a hollow spray tube for use with a nozzle of a spray can, the holder having a first ring for encircling part of the spray can (or container) for mounting the holder thereto, an interconnection member having a first end and a second end, the first end connected to or formed integrally with the first ring, and a holding ring connected to or formed integrally with the second end of the interconnection member, the holding ring for holding the hollow spray tube or straw; such a holder wherein the first ring is made of stretchable material and is stretchable for releasable positioning around the spray can or container; such a holder wherein the holding ring is made of stretchable material for releasable holding of the spray tube or straw; such a holder wherein the nozzle has a hollow lower projection insertable into a top opening in the spray can or container and the holder's first ring is sized for receiving the hollow lower projection of the nozzle therethrough for releasable securement of the holder to the spray can or container; such a holder including the straw or the hollow spray tube; such a holder wherein the spray can or container has a top portion and the first ring is sized for emplacement on the top potion; such a holder wherein the first ring is made of resilient material for snap-on emplacement on the top portion and for snap-off removal therefrom; such a holder wherein the top portion of has an upper rim and the first ring has an inner groove for receiving and holding the upper rim; and such a holder wherein the first ring is made of resilient material for releasably holding the upper rim.

The present invention, in certain aspects, discloses a spray tube apparatus for use with a nozzle of a spray can, the nozzle having a fluid flow channel therethrough and an exit port from which contents of the spray can are propelled by manual pump action or by gas under pressure within the spray can, the spray tube apparatus having a hollow spray tube insertable into the exit port of the nozzle; a tube holder for holding the hollow spray tube, the tube holder having a first ring for encircling part of the can for mounting the tube holder to the can, an interconnection member having a first end and a second end, the first end connected to or formed integrally with the first ring, a holding ring for holding the tube and connected to or formed integrally with the second end of the interconnection member, the holding ring for holding the hollow spray tube, the first ring made of stretchable material and stretchable for releasable positioning around the spray can, and the holding ring made of stretchable material for releasable holding of the hollow spray tube; such a holder wherein the nozzle has a hollow lower projection insertable into a top opening in the spray can and the holder's first ring sized for receiving the hollow lower projection of the nozzle therethrough for releasable securement of the holder to the spray can; and such a holder wherein the spray can has a top portion with an upper rim and the first ring is made of resilient material for snap-on emplacement on the upper rim and for snap-off removal therefrom.

The present invention discloses, in certain embodiments a beverage container or spray can with a hollow body with contents therein (and, in the spray can, gas under pressure or a manual action pump for expelling the contents therefrom), and, with respect to the spray can, a nozzle connected to the spray can and having a fluid flow channel therethrough with an exit port for the passage of the contents out from the spray can; a hollow spray tube or a straw usable with the beverage container insertable into the exit port of the nozzle and a holder for holding the straw or spray tube, the holder having a ring for encircling part of the container or spray can for mounting the holder thereto; an interconnection member having a first end and a second end, the first end connected to or formed integrally with the ring, and a holding member holding the straw or hollow spray tube and connected to or formed integrally with the second end of the interconnection member; such a container or can wherein the ring is made of stretchable material to facilitate emplacement thereof, and wherein the holding member is a holding ring made of stretchable material for releasable holding of the straw or hollow spray tube; such a spray can wherein the nozzle has a hollow lower projection insertable into a top opening in the spray can and the holder's first ring sized for receiving the hollow lower projection of the nozzle therethrough for releasable securement of the tube holder to the spray can; and such a container or spray can wherein the holding member has at least one slit opening therethrough, the straw or hollow spray tube insertable through and removably holdable in the at least one slit opening.

It is, therefore, an object of at least certain preferred embodiments of the present invention to provide:

New, useful, unique, efficient, nonobvious devices for a holder for a tube used with a container and a container with such a tube; such a holder having a flexible portion for removable installation around a part of a container;

Such a holder for a spray tube for a manual pump action bottle or container, for an aerosol spray can, or for a straw for a beverage container;

A holder with a second flexible portion for connection to the tube;

A holder with an interconnecting member connected to a first flexible portion for connection to the tube;

A holder with first and second flexible members, one for removable positioning around part of the container and one for removably holding the tube;

A holder with a first flexible member for positioning around part of a container and a tube holder with a body having one or more tabs projecting from the first ring and connected thereto or formed integrally thereof; and A container with any such tube holder.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1A is a perspective view of a tube holder according to the present invention. FIG. 1B is another perspective view of the tube holder of FIG. 1A. FIG. 1C shows a container according to the present invention with a tube holder as in FIG. 1A according to the present invention. FIG. 1D shows the container of FIG. 1C with a cap removed and the tube holder inserted into an exit port in a nozzle of the container. FIG. 1E is a perspective view that shows an alternative embodiment for a tube holder according to the present invention.

FIG. 2A shows a tube holder according to the present invention and FIG. 2B shows it connected to a tube. FIG. 2C shows the tube holder and the tube of FIG. 2B installed on a container according to the present invention.

FIG. 3A is a perspective view of a tube holder according to the present invention. FIG. 3B shows the tube holder and the tube of FIG. 3A installed on a container according to the present invention. FIG. 3C is a perspective view of an alternative embodiment for the tube holder of FIG. 3A and FIG. 3D is a cross-section view of the tube holder of FIG. 3C.

FIG. 4A is a perspective view of a tube holder according to the present invention. FIG. 4B shows the tube holder and the tube of FIG. 4A installed on a container (shown partially) according to the present invention. FIG. 4C is an exploded view of the container, tube, and tube holder of FIG. 4B.

FIGS. 19 and 20 are cross-section views of a cap and lid for a spray can according to the present invention.

FIG. 21 is a perspective view of a spray can according to the present invention with a tube holder according to the present invention. FIG. 22 is a cross-section view of part of the spray can of FIG. 21.

FIG. 23 is a perspective view of a spray can according to the present invention with a tube holder according to the present invention. FIG. 24 is a cross-section view of part of the spray can of FIG. 23.

FIG. 25 is a perspective view of a spray can according to the present invention with a tube holder according to the present invention. FIG. 26 is a perspective view of the cap of the spray can of FIG. 25. FIG. 27 is a cross-section view of part of the cap of the spray can of FIG. 25.

FIG. 28 is a perspective view that shows an alternative for connecting a tube holder to a cap for a spray can.

DESCRIPTION OF EMBODIMENTS PREFERRED AT THE TIME OF FILING FOR THIS PATENT

Figures 5A, 5B, 6A, 6B, 6C:
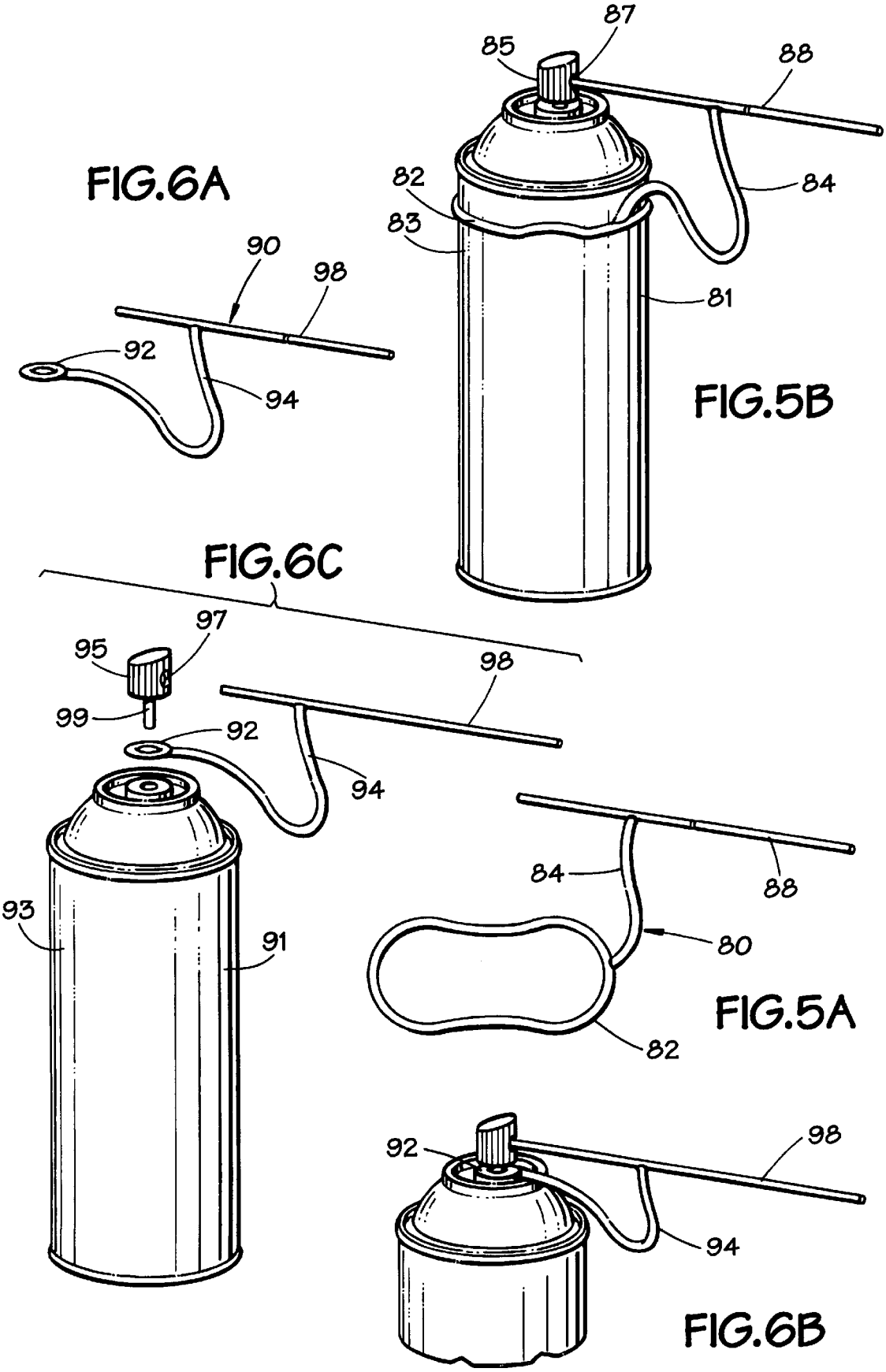
FIG. 5A is a perspective view of a tube holder according to the present invention.
FIG. 5B shows the tube holder and the tube of FIG. 5A installed on a container according to the present invention.
FIG. 6A is a perspective view of a tube holder according to the present invention.
FIG. 6B shows the tube holder and the tube of FIG. 6A installed on a container (shown partially) according to the present invention.
FIG. 6C is an exploded. view of the container, tube, and tube holder of FIG. 6B.

FIGS. 1A and 1B show a tube holder 10 according to the present invention which has a flexible stretchable ring 12 (made, e.g. of rubber, plastic, or any suitable elastic material; and in another aspect made of non-stretchable material); an interconnection member 14 connected to, adhered to, or formed integrally of the ring 12; and a holding member 15 with one or more slits 16 (two shown in this embodiment) extending therethrough. The interconnection member 14 is any desired length and may be made of stretchable or non-stretchable material. As shown in FIG. 1B, a hollow spray tube 18 has been pushed through the slits 16 in the holding member 14. The slits 16 are sized to permit passage therethrough of a tube while holding the tube so it will not inadvertently fall out. The slits are also sized so that the tube is removable from the holding member 14.

FIG. 1C shows the ring 12 stretched around a spray can 20 which has a body 22, a removable cap 24, a spray nozzle 26 with an exit port 28. As shown in FIG. 1C the tube 18 is held against the body 22 by the ring 12, and the ring 12 is movable on the body 22. As shown in FIG. 1D, the ring 12 remains around the body 12 when the tube 18 is inserted in the exit port 28 of the spray nozzle 26.

Following use, the tube 18 may be removed from the holding member 14 and discarded and a new tube may be inserted therethrough, or the tube 18 may be retained for future use. The entire tube holder and tube may be removed for future use on the same or on another can.

FIG. 1E shows a tube holder 30 like the tube holder 10 (similar numerals indicate like parts), but with a holding member 34 that has a single hole 36 therethrough for releasably holding a tube 19 like the tube 18. In one aspect the holding member 34 is made of pliable material so it can accommodate several different diameter tubes.

FIG. 2A shows a tube holder 40 according to the present invention which has a first ring 42; an interconnection member 44 secured to or formed integrally of the first ring 42; and a second ring 46 secured to or formed integrally of the interconnection member 44. In one aspect the first ring 42, interconnection member 44, and/or the second ring 46 are all made of a flexible stretchable material. FIG. 2B shows the second ring 46 releasably entwined around a hollow spray tube 48. FIG. 2C shows the tube 48 inserted in an exit port 41 of a nozzle 43 of an aerosol container 45 and the first ring 42 releasably encircling the container 45.

FIG. 3A shows a tube holder 50 according to the present invention with a ring 52 made of rigid (i.e. relatively non-flexible) material; an interconnection member 54 (made, e.g. of either stretchable or non-stretchable material); and a hollow tube 56 formed integrally of or permanently secured to the interconnection member 54. The ring 52 fits on and around the top of a container 51 (see FIG. 3B). The tube 56 is inserted in an exit port 53 of a spray nozzle 55 of the container 51. The ring 52 may be any desired shape to correspond to the shape of a container (e.g. but not limited to, round, square, rectangular, hexagonal, pentagonal, etc.).

FIGS. 3C and 3D show a tube holder 60 like the tube holder 50 (similar parts indicated by like numerals), but with a ring 62 that has an inner groove 64 for receiving and holding a top rim of a can or container. The ring 62 may be made of resilient material so that it is emplaceable on a can's top rim and not removable (or removable only with difficulty) therefrom; or the ring 62 may be somewhat flexible so that it may be snapped on and snapped off of a can's top rim. The ring 62 may be any desired shape as viewed from above.

FIG. 4A shows a tube holder 70 according to the present invention with a first ring 72; an interconnection member 74; and a second ring 76. These pieces may be formed together integrally as a single unitary item or they may be adhered together or otherwise connected. As shown in FIGS. 4B and 4C, the first ring 72 is sized to receive a lower hollow projection 71 of a spray nozzle 73 of an aerosol container 75 while the second ring 76 is sized to releasably receive and hold a tube 78 which may have one end 79 inserted in an exit port 77 of the spray nozzle 73.

FIG. 5A shows a tube holder 80 according to the present invention with a stretchable ring 82; an interconnection member 84 connected to or formed integrally with the stretchable ring 82; and a hollow spray tube 88 permanently connected to an end of the interconnection member 84 (or, in another aspect, formed integrally therewith). FIG. 5B shows the tube holder 80 installed on a can 81 according to the present invention that has a body 83, and a spray nozzle 85 with an exit port 87 into which an end of the hollow tube 88 is inserted.

FIG. 6A shows a tube holder 90 according to the present invention with a stretchable ring 92; an interconnection member 94 connected to or formed integrally with the stretchable ring 92; and a hollow spray tube 98 permanently connected to an end of the interconnection member 94 (or, in another aspect, formed integrally therewith). FIG. 6B shows the tube holder 90 installed on a can 91 according to the present invention that has a body 93, and a spray nozzle 95 with an exit port 97 into which an end of the hollow tube 98 is inserted. The ring 92 is sized to fit around the projecting portion 99 and, in one aspect, to fit snugly yet removably therearound.

Other embodiments of the tube holders disclosed herein may use a partial rigid ring (instead of a closed stretchable ring) for releasable snap-on emplacement around a can or part thereof. Also, any tube-holding ring or structure may be sized and fashioned to fit around any part of a container, cap for a container, or nozzle (so long as flow is not blocked). It is within the scope of this invention for any tube holder disclosed herein to be used as a straw holder for a straw for a beverage container with a drinking straw substituted for the tube and a beverage container substituted for the spray can.

Figure 7A:
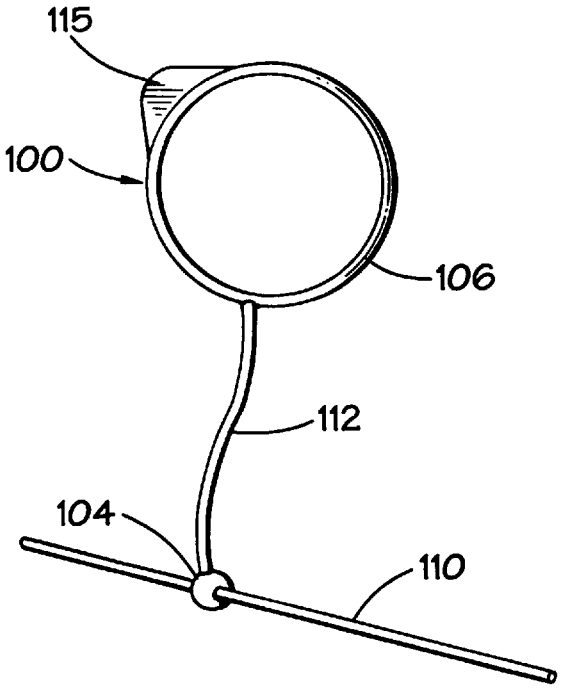
FIG. 7A is a top view of a tube holder according to the present invention.
Figure 7B:
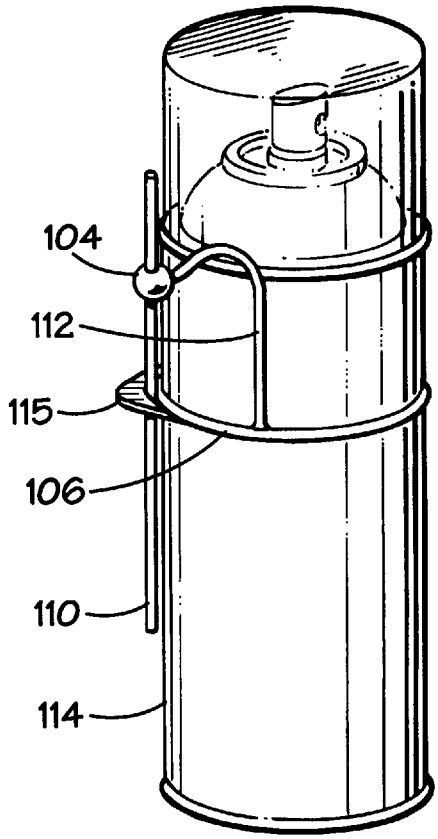
FIG. 7B is a side perspective view that shows a tube holder as in FIG. 7A with a spray can according to the present invention.

FIGS. 7A and 7B show a tube holder 100 according to the present invention which is like the tube holder 30 of FIG. 1E and a spray can 114 (like spray cans described previously herein) with such a tube holder according to the present invention. A holding ring or member 104 is made of stretchable material for accommodating and holding a drinking straw (not shown) or a hollow spray tube 110 (FIG. 7B). A flexible interconnection member 112 has one end connected to or formed integrally with the holding ring 104 and the other end connected to or formed integrally with a stretchable ring 106. The ring 106 is sized and configured for releasable emplacement around a beverage container (not shown) or around a spray can 114 (FIG. 7B). A tab 115 for facilitating handling, manipulation, and movement of the ring 106 is connected to or formed with the ring 106.

In one aspect the tube holder 100 is molded as a single-piece plastic item. Alternatively, the ring or member 104 can be like the holding member 15 (FIG. 1A). The ring 106 may be any desired size and, in one aspect, is sized for emplacement around a spray can's spray nozzle. Also it is within the scope of this invention to provide a tab like the tab 115 on any ring of any embodiment disclosed herein, and any such embodiment may have one, two, three or more such tabs.

Figure 7C:
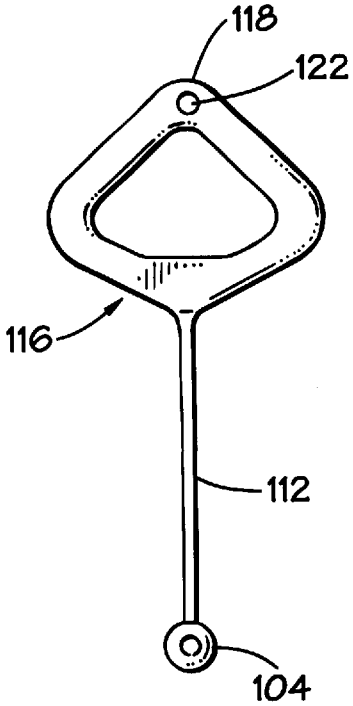
FIG. 7C is a top view of a tube holder according to the present invention.

FIG. 7C shows a tube holder 116 like the tube holder 100 and similar parts bear the same identifying numerals. A tab 118 (similar to the tab 114, FIG. 7A) has a hole 108 therethrough for releasably holding a spray tube. Any tab on any embodiment hereof may have such a hole.

Figure 7D:
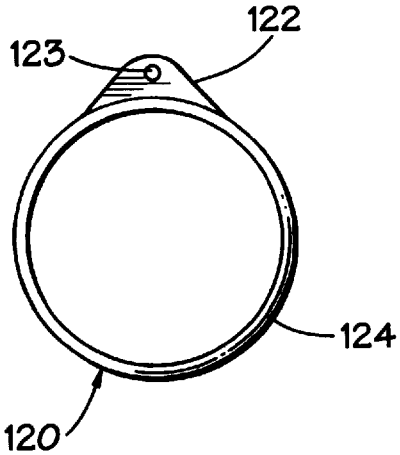
FIG. 7D is a top view of a tube holder according to the present invention.
Figure 8A:
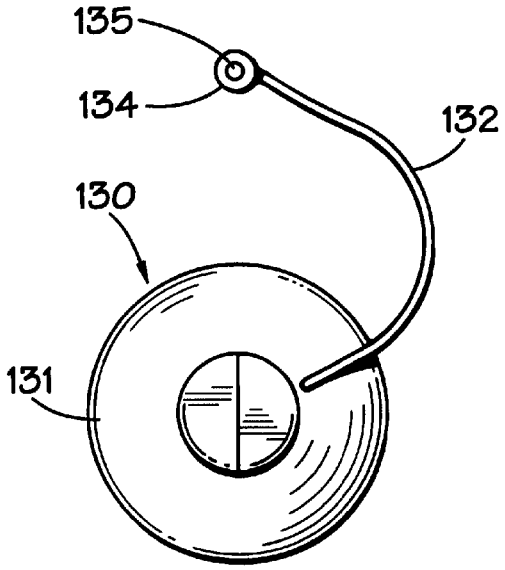
FIG. 8A is a top view of a tube holder according to the present invention.
Figure 8B:
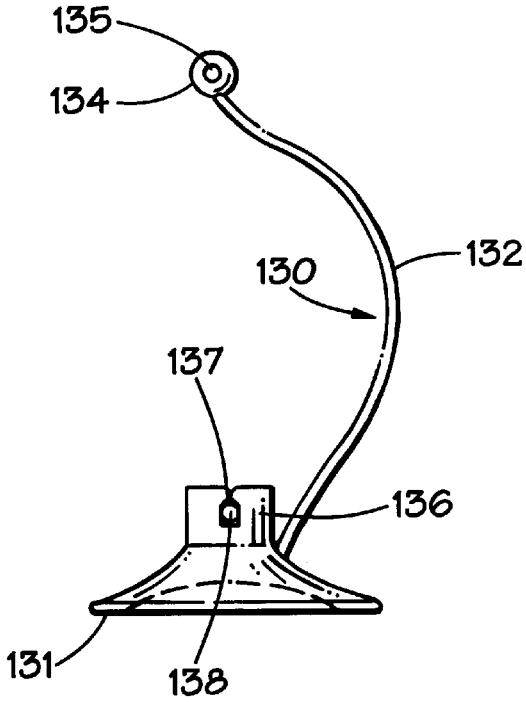
FIG. 8B is a side view of the tube holder of FIG. 8A.
Figure 8C:
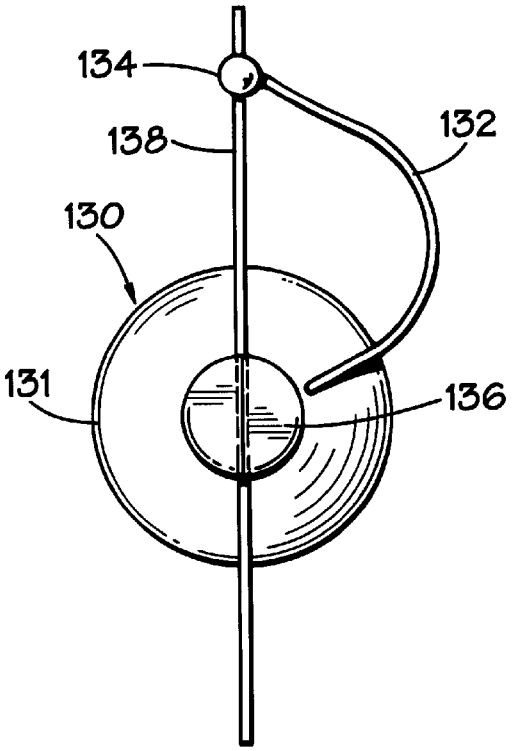
FIG. 8C is a top view of the tube holder of FIG. 8A with a tube.
Figure 8D:
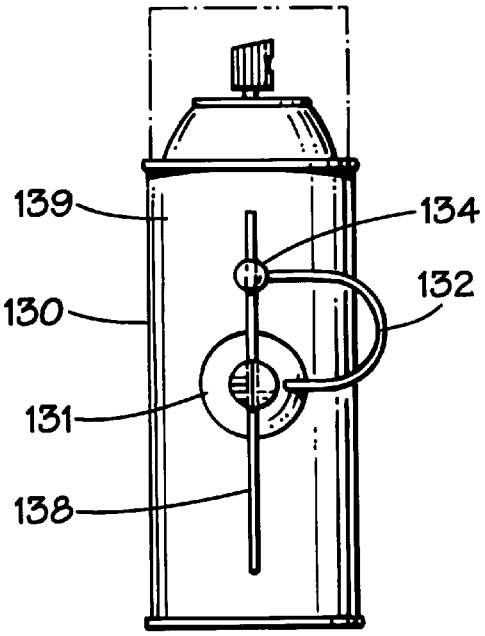
FIG. 8D is a side view that shows the tube holder of FIG. 8A on a spray can.

FIG. 7D shows a tube holder 120 according to the present invention with a stretchable ring 121 having a tab. 122 connected to or formed of the ring 121. The tab 122 has a hole 123 for releasably holding a spray tube of a spray can (or a drinking straw).

FIGS. 8A–8D show a tube holder 130 according to the present invention with a suction cup 131 having a top 136 with an optional recess 137 therethrough for releasably holding a spray tube 138 (or drinking straw). A flexible interconnection member 132 has one end connected to or formed with the suction cup 131 and the other end connected to or formed with a tube holder 134 having a hole 135 therethrough for releasably holding the spray tube 138.

Alternatively an extra spray tube (not shown) may be held in the hole 135 and/or the tube 138 may be deleted. In another aspect, the interconnection member 132 and holder 134 are deleted. The holder 134 may be like any holder described herein. In addition to or instead of suction, glue or any suitable adhesive may be used to secure the member 131 to a can (or container). Alternatively, the recess 137 may be sized to hold part of any of the tube holders described herein. In one aspect, the recess 137 is sized to releasably hold an interconnection member and/or a first ring of any of the tube holders described herein, including, but not limited to a ring like the ring 12, 42, 52, 62, 72, 82, 92, 106, or 121.

Figure 9:
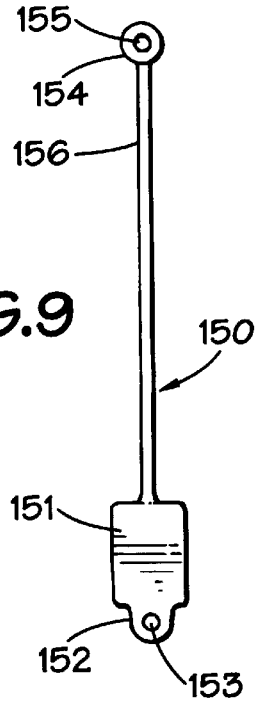
FIG. 9 is a top view of a tube holder according to the present invention.

FIG. 9 shows a tube holder 150 according to the present invention with a securement member 151 having a tab 152 formed thereof or connected thereto. The tab 152 has an optional hole 153 for releasably holding a spray tube (or a drinking straw). A flexible interconnection member 156 has one end connected to or formed of the securement member 151 and the other end connected to or formed of a tube holder 154. The tube holder 154 has a hole 155 therethrough for releasably holding a spray tube. The securement member 151 is taped or glued to a spray can. Alternatively, the securement member 151 may be releasably held by a friction fit in a recess 157 formed in a can 158 (FIG. 10) or a drinking glass. The recess 157 may be located anywhere on a spray can.

Figure 11:
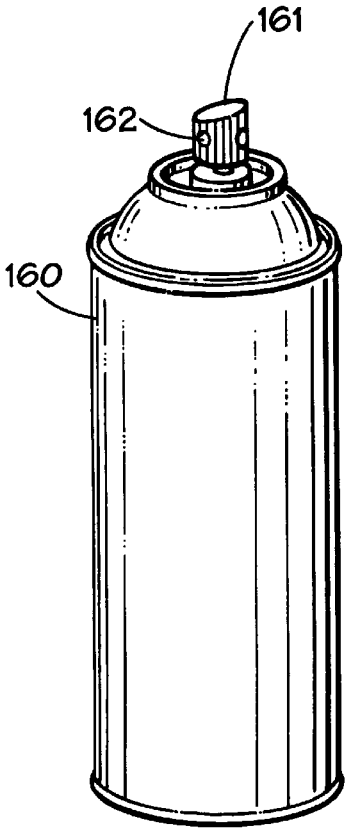
FIG. 11 is a side view of a cylindrical spray can according to the present invention.

FIG. 11 shows a spray can 160 according to the present invention with a spray nozzle 161 having a hole 162 therethrough for releasably holding a spray tube.

Figure 12:
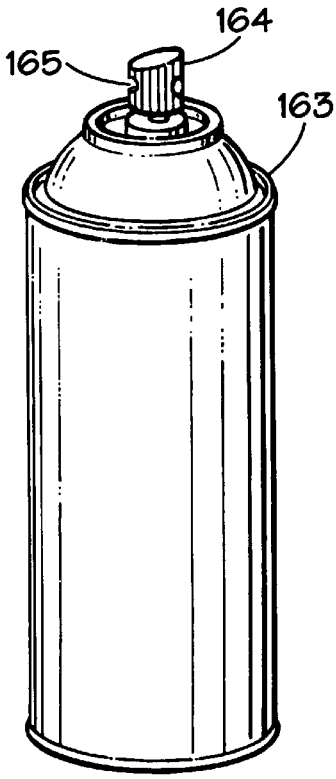
FIG. 12 is a side view of a cylindrical spray can according to the present invention.

FIG. 12 shows a spray can 163 according to the present invention with a spray nozzle 164 having a notch 165 therein for releasably holding a spray tube.

Figure 10:
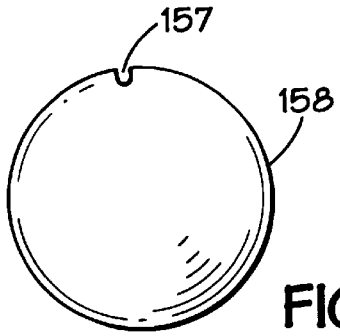
FIGS. 10 and 10A are top views of cylindrical spray cans according to the present invention.
Figure 10A:
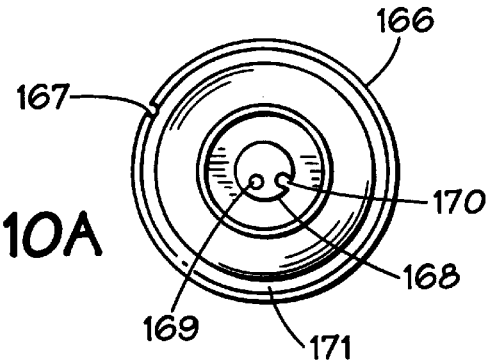

FIG. 10A shows a spray can 166 according to the present invention with a spray nozzle 168 having a hole 169 therethrough for releasably holding a spray tube and an optional notch 170 for releasably holding a spray tube. Also, an optional notch 167 formed in the body 171 of the can 166 releasably holds a spray tube.

Figure 13:
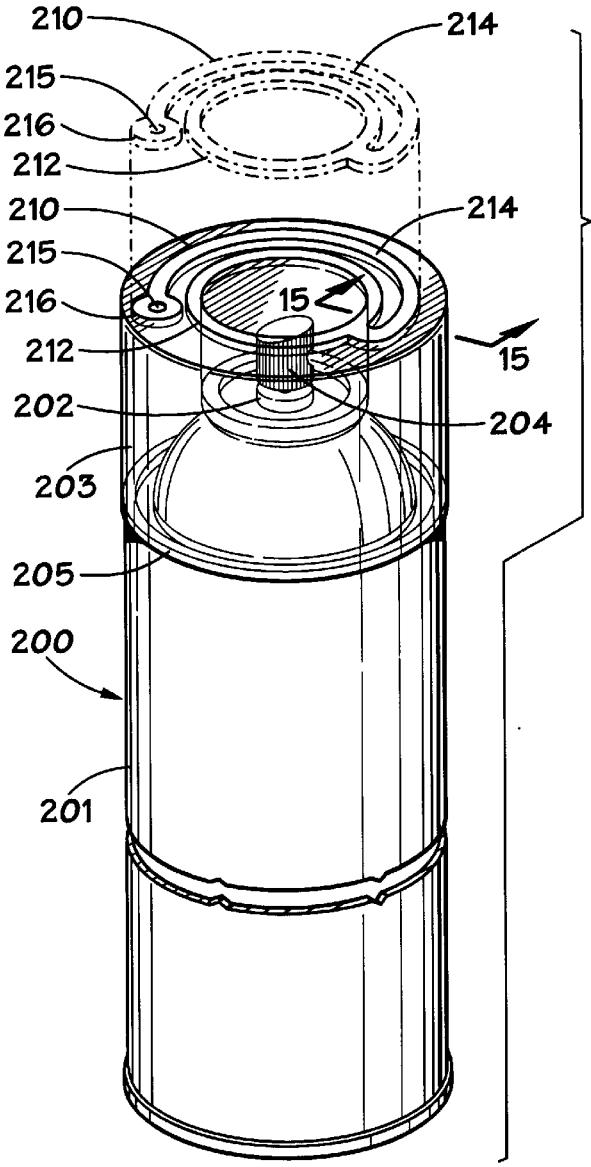
FIG. 13 is a perspective view of a spray can according to the present invention with a tube holder according to the present invention.

Any spray can disclosed herein may have any or all of the holes and/or notches in the embodiments of FIGS. 11–13 and/or the recess 157 of FIG. 10. Each notch may be sized and configured for a snap-fit around a tube.

In any embodiment hereof it is within the scope of this invention to form a spray tube or straw integrally of a tube holder.

The present invention discloses, in certain embodiments, a tube holder for holding a hollow spray tube, the tube holder having a first ring, an interconnection member having a first end and a second end, the first end connected to or formed integrally with the first ring, a holding ring connected to or formed integrally with the second end of the interconnection member, the holding ring made of stretchable material for releasably holding a hollow spray tube, and at least one tab projecting from the first ring and connected thereto or formed integrally thereof; and any such tube holder, method of use thereof, and/or spray can therewith as disclosed herein and/or as defined in the claims that follow.

FIG. 13 shows a spray can 200 and a tube holder 210 according to the present invention. The can 200 includes a typical hollow spray can body 201 with spray nozzle apparatus 202. A cap 203 covers a nozzle 204 of the nozzle apparatus 202. The cap 203 fits over a rim 205 with a friction fit and is selectively removable from the can.

The tube holder 210 is formed integrally of the cap 203 and is selectively removable therefrom by disengaging it from the cap 203. The tube holder 210 has a first ring 212 connected by an interconnection member 214 to a second ring 216. The second ring 216 has a hole 215 therethrough for receiving a tube (not shown) so that the second ring 216 releasably holds the tube.

Figure 14:
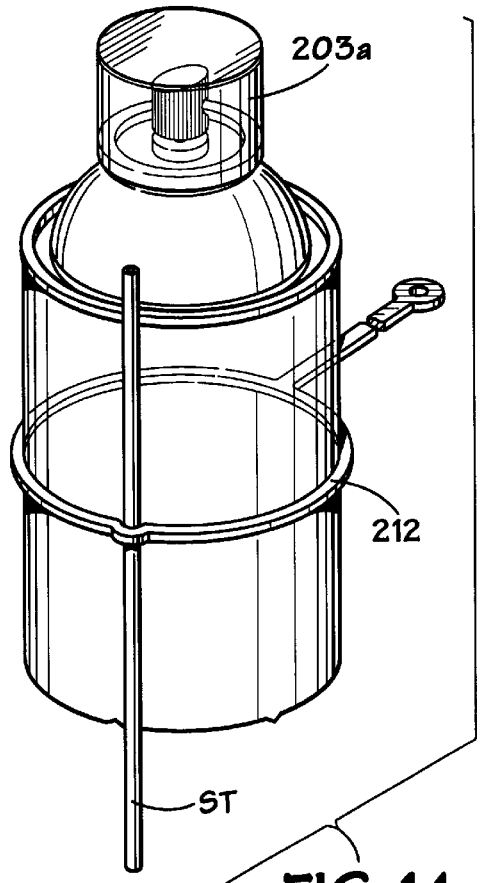
FIG. 14 is a perspective view of a spray can according to the present invention with a tube holder according to the present invention.

FIG. 14 shows a tube holder 210 removed from the cap 203 and, optionally, a portion 203*a* of the cap 203 also removed from the cap 203 and emplaced on the cap 203 around the nozzle apparatus 202. The cap portion 203*a* is made, sized and configured so that, upon removal of the tube holder from the cap 203, the cap portion 203*a* remains intact when the tube holder 210 is separated from it. Any method and structure disclosed herein may be used at the tube holder 210/cap portion 203*a* interface to facilitate separation of the two.

The ring 212 may be stretchable and flexible so that it can hold a spray tube ST against a spray can (as in FIG. 14); or the ring 212 (and any ring herein) can be less flexible, nonstretchable, and/or rigid or semi-rigid so that it is held with a friction fit around a can part around a cap, or around a cap portion like the portion 203*a*. In other embodiments the ring 212 may be a partial ring that is snapped on around a can, cap, or part thereof. Similarly the member 256 (FIG. 25) is surrounded by flexible material; or the member 256 may be rigid with the hole 255 precisely sized for holding a tube or straw by a friction fit.

Figure 15:
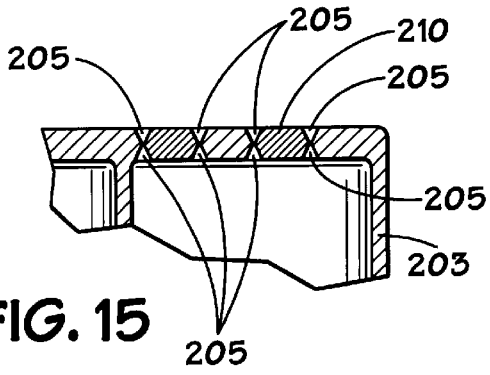
FIG. 15 is a cross-section view along line 15—15 of FIG. 13.
Figure 15A:
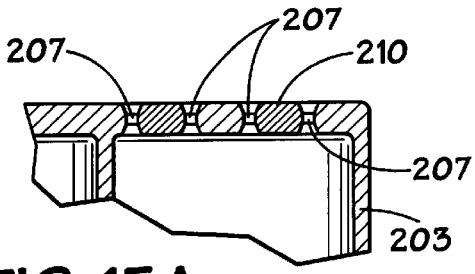
FIG. 15A is a cross-section view showing an alternative structure for the cap of the spray can of FIG. 13.
Figure 16:
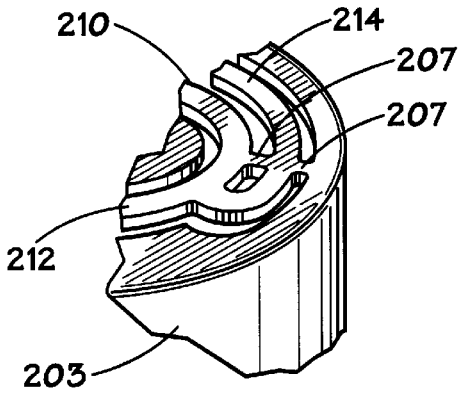
FIG. 16 shows detail of the cap of the spray can of FIG. 15A.

FIG. 15 shows detail of the structure of the cap 203 and tube holder 210 that allows the tube holder 210 to be removed from the cap 203. Incisions or cuts 205 (e.g. made with a knife or die) surround the boundaries of the tube holder 210 and weaken the cap 203/tube holder 210 interface to facilitate disengagement of the tube holder 210 from the cap 203. Alternatively, as shown in FIG. 15A, the cap 203 is molded to include the form of the tube holder 210 which is initially connected to the cap 203 by small plastic pieces or "sprues" 207 which are easily breakable to permit removal of the tube holder 210 from the cap 203. FIG. 16 shows details of two of the pieces 207.

Figure 17:
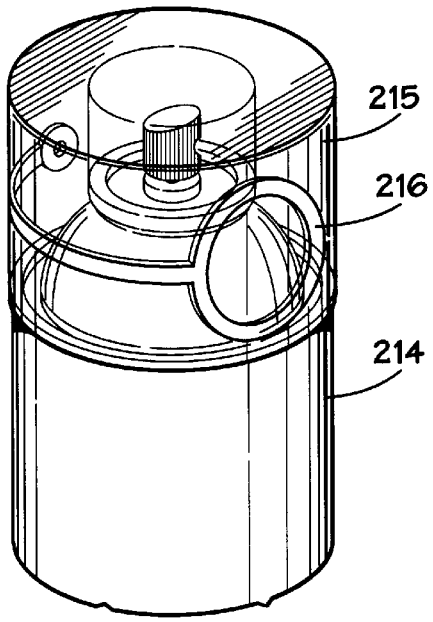
FIG. 17 is a perspective view of a spray can according to the present invention with a tube holder according to the present invention.

FIG. 17 shows a spray can 214 like the spray can 200 with a cap 215 having a tube holder 216 (like the tube holder 210). The tube holder 216 is formed integrally of the cap 215 and is made removable by using structure and/or cuts as in FIGS. 15 or 15A. Alternatively, the tube holders 210, 216 may be separate pieces connected and/or adhered to their related spray cans and/or to their corresponding caps. In any of these embodiments, the tube holder may be formed of or connected to a cap so that it is removable from the inside of the cap; from the outside thereof; or from both.

Figure 18:
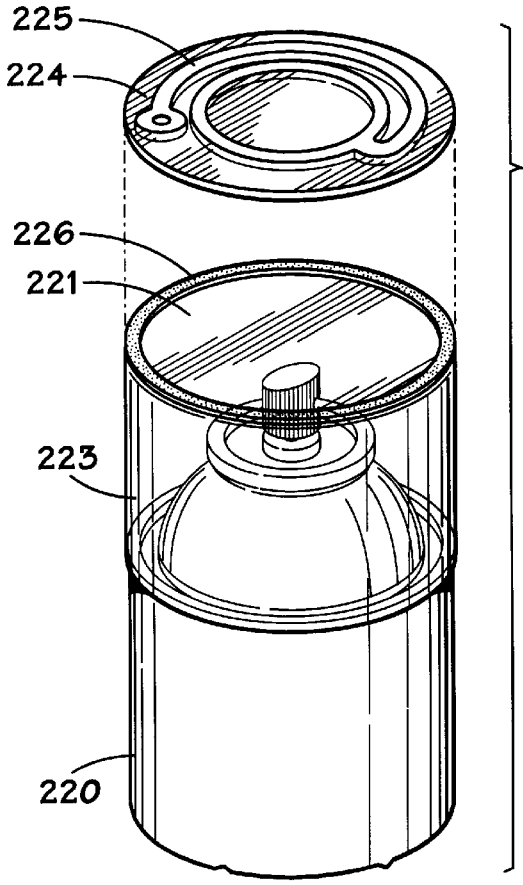
FIG. 18 is a perspective view of a spray can according to the present invention with a tube holder according to the present invention.
Figure 19:
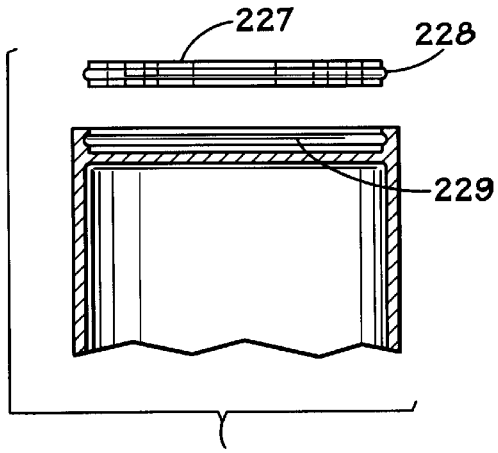

FIG. 18 shows a spray can 220 (like the spray cans 200, 214) with a cap 223. The cap 223, optionally, has a top part 221. A secondary lid 224 is either permanently or releasably connected and/or adhered to the top of the top part 221. The top part 221 may be omitted and the lid 224 may close off the can top. Alternatively, it is emplaced against the bottom of the top part 221 within the cap 223. A tube holder 225 (e.g. like that of FIGS. 13 and 17) is connected to or formed integrally of (as in any way disclosed herein) the secondary lid 224. In one aspect, adhesive 226 is used to attach the secondary lid 224 to the top part of the cap 223. In another aspect, illustrated in FIG. 19, a secondary lid 227 has an outer lip 228 that fits with a snap-fit (releasable or not) into a corresponding recess 229 in the cap 223. FIG. 20 shows a secondary lid 227 in place in a cap 223. The secondary lids in FIGS. 19 and 20 may include a tube holder like the tube holder 224. A tube holder formed integrally of another part may, according to the present invention, be placed inside of any cap for any spray can, with either the another part initially attached or connected to the cap or not.

FIG. 21 shows partially a spray can 230 (like the cans of FIGS. 13, 18) with a secondary bottom member 231 that is releasably emplaceable within a lower edge 232 (see FIG. 22) of the can 230 by a friction fit and/or with adhesive or glue. A tube holder 234 (like those of FIGS. 13, 17, 18) is connected to or formed integrally of (as any disclosed herein) the secondary bottom member 231. To use the tube holder 234, the secondary bottom member 231 is removed from the bottom of the spray can 230 and then the tube holder 234 is removed or disengaged from the secondary bottom member 234. Alternatively a loose tube holder is enclosed within a bottom space by a secondary bottom member.

FIGS. 23 and 24 show another way according to the present invention to releasably connect a secondary bottom member 231*a* (like member 231) to the bottom of a spray can 230*a* (like can 230). The secondary bottom member 231*a* has a notch 235 therearound which releasably holds a lower edge 236 of the can 230*a*.

FIGS. 25–28 show that, according to the present invention, a cap for a spray can may be like the smaller type (known in the prior art) which covers the nozzle apparatus. Such caps are not as wide as the can itself. A spray can 240 according to the present invention (show partially; with major parts like those previously disclosed herein) has a cap 243 according to the present invention which includes a tube holder 250 formed integrally thereof. The tube holder 250 has a first ring 252 that, following removal of the tube holder 250 from the cap 243, formed for or is stretchable to releasably encircle the cap 243, a ring 244 around the top of the can 240, and/or the can body 245. The ring 252 is connected to a holding member 256 by a connection member 254. The holding member 256 has a hole 255 for releasably holding a tube.

As shown in FIGS. 26 and 27, cuts or incisions 247 leaving small breakable holding members 247*a* facilitate removal of the tube holder 250 from the cap 243. Alternatively the tube holder/cap may be molded with a recess therearound which results in a relatively thin wall or member (without any cuts or incisions) holding the tube holder to the cap, the thin wall or member easily breakable or tearable to permit removal of the tube holder. Such a wall or member would look, in cross-section, like the structure shown in FIG. 27. Such thin wall or thin member structure may also be used with the caps of FIGS. 13, 17, 18, 21 and 22 to permit disengagement of an integrally formed tube holder and/or cap portion like cap portion 203*a*. FIG. 28 shows a cap 243*a* (like the cap 243), but with molded small pieces or sprues 249 releasably holding the tube holder 250 to the cap 243.

Figure 29:
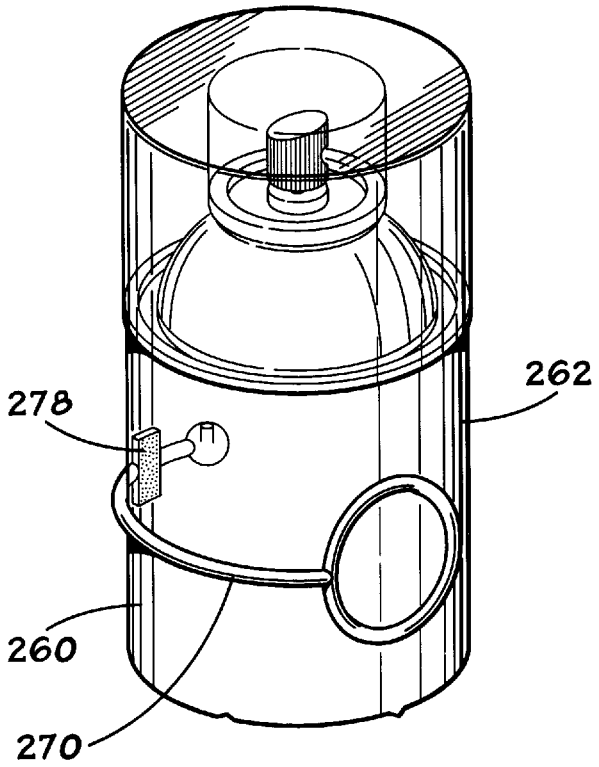
FIG. 29 is a perspective view of a spray can according to the present invention with a tube holder according to the present invention.
Figure 30:
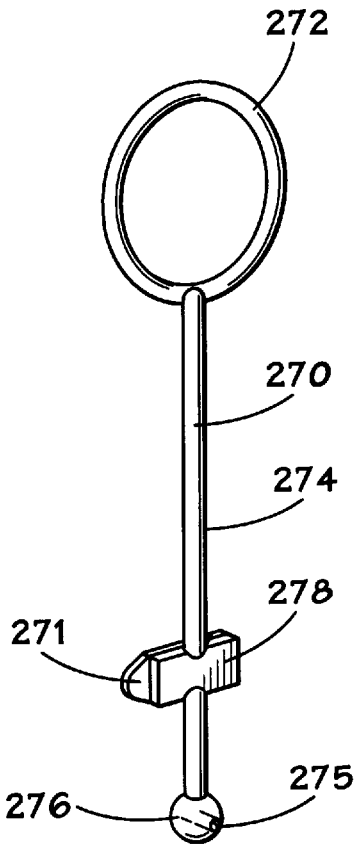
FIG. 30 is a perspective view of the tube holder of FIG. 29.
Figure 31:
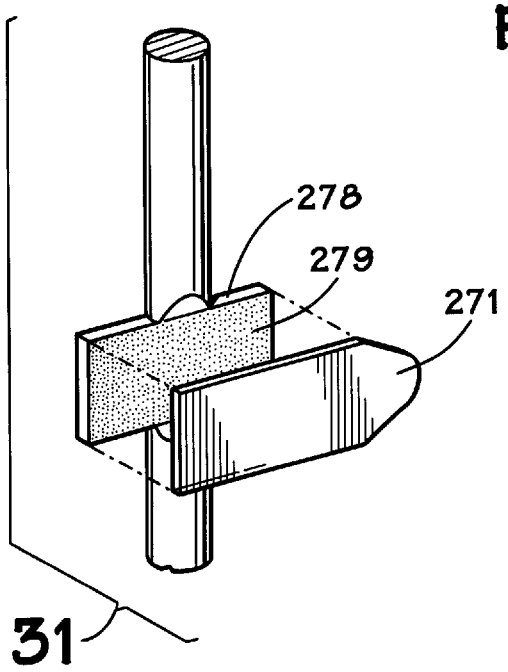
FIG. 31 is a partial perspective view of the tube holder of FIG. 30.

FIGS. 29–31 show a spray can 260 (like any disclosed herein) having a hollow body 262. A tube holder 270 according to the present invention is initially connected to, taped to, or adhered to the outer surface of the can 260. Upon initial detachment from or removal from the can 260, a piece of protective tape or material 271 is removed to expose an amount of adhesive 279 on a tab 278 which is connected to or formed of a connection member 274. The adhesive 279 permits re-connection of the tube holder 270 to any part of the can to prevent loss or misplacement of the tube holder 270 during or following use of the can. The connection member 274 connects a first ring 272 (e.g. like ring 212, FIG. 13) to a tube holder member 276 that has a hole 275 therethrough for receiving a tube.

It is within the scope of this invention for any tube holder in any FIGS. 13–31 to be any tube holder disclosed herein. Such a tab of any size or shape may be used at any location on a tube holder and a single tube holder may have two, three or more of the tabs. Optionally (as may be done with any tube holder disclosed herein) the connection member 274 may be deleted and either the member 276 is incorporated into the ring 272; or a hole is provided through the ring 272, in which cases the member 278 may be deleted or may be connected to or formed of the ring 272.

The present invention, therefore, provides in certain, but not necessarily all embodiments, a spray can system with a spray can with a hollow body with contents therein and gas under pressure for expelling the contents therefrom, and nozzle apparatus connected to the spray can and having a nozzle with a fluid flow channel therethrough with an exit port for the passage of the contents out from the spray can, a cap releasably emplaced on the hollow body for covering the nozzle apparatus, a tube holder comprising a tube holder for holding a spray tube insertable into the nozzle, and the tube holder formed of the cap and separable therefrom for use on the spray can. Such a system may include one or some of the following, in any possible combination: the tube holder with a ring for encircling part of the spray can for mounting the tube holder to the spray can, an optional interconnection member having a first end and a second end, the first end connected to or formed integrally with the ring, and a holding.member for holding the hollow spray tube either connected to or fromed integrally of the ring, or connected to or formed integrally with the second end of the interconnection member; wherein the ring is made of flexible stretchable material; wherein the tube holder is separable from a top of the cap; wherein the tube holder is separable from an interior portion of the cap; wherein the cap includes a sub-cap separable from the cap for releasably covering the nozzle apparatus following separation of the tube holder from the cap; wherein the tube holder is on a secondary member and separable therefrom and the secondary member is releasably connected to the cap; wherein the cap has an open top and the secondary member is emplaced over the open top, closing off the open top; and/or wherein the cap has a lower edge and the tube holder is initially releasably connected to the lower edge of the cap.

The present invention, therefore, provides in certain, but not necessarily all embodiments, a spray can system with a spray can with a hollow body with contents therein and gas under pressure for expelling the contents therefrom, and nozzle apparatus connected to the spray can and having a nozzle with a fluid flow channel therethrough with an exit port for the passage of the contents out from the spray can, a cap releasably emplaced on the hollow body for covering the nozzle apparatus, a tube holder for holding a spray tube insertable into the nozzle, the spray can having a bottom edge, and wherein the tube holder is on a secondary member and separable therefrom and the secondary member is releasably connected at the bottom edge of the spray can. Such a system may include one or some of the following, in any possible combination: wherein the secondary member is releasably held within the bottom edge of the spray can by a friction fit therewith; wherein the secondary member has a recess therein in which the bottom edge of the spray can is releasably held; the tube holder with a ring for encircling part of the spray can for mounting the tube holder to the spray can, an optional interconnection member having a first end and a second end, the first end connected to or formed integrally with the ring, a holding member for holding the hollow spray tube and connected to or formed integrally with the second end of the interconnection member, and the tube holder formed of the cap and separable therefrom; and/or wherein the ring is made of flexible stretchable material.

The present invention, therefore, provides in certain, but not necessarily all embodiments, a tube holder for holding a hollow spray tube or straw, the tube holder with a first ring for encircling an item such as a spray can or container, a holding member connected to or formed integrally with the ring, the holding member having a hole therethrough for receiving a spray tube, and at least one adhesive member on the tube holder for releasably attaching the tube holder to another item. Such. a system may include one or some of the following, in any possible combination: the another item is a spray can or container; a removable cover on the at least one adhesive member for selectively exposing adhesive thereon; an interconnection member having a first end and a second end, the first end connected to or formed integrally with the first ring and the holding member connected to the second end; a spray can, the tube holder releasably connected to the spray can; and/or wherein the spray can has a hollow body with contents therein and gas under pressure for expelling the contents therefrom, and nozzle apparatus connected to the spray can and having a nozzle with a fluid flow channel therethrough with an exit port for the passage of the contents out from the spray can, and a cap releasably emplaced on the hollow body for covering the nozzle apparatus.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A spray can system comprising a spray can with a hollow body with contents therein and gas under pressure for expelling the contents therefrom, and nozzle apparatus connected to the spray can and having a nozzle with a fluid flow channel therethrough with an exit port for the passage of the contents out from the spray can, a cap releasably emplaced on the hollow body for covering the nozzle apparatus, a tube holder for holding a spray tube insertable into the nozzle, the spray can having a bottom edge, and wherein the tube holder is on a secondary member and separable therefrom and the secondary member is releasably connected at the bottom edge of the spray can.

2. The spray can system of claim 1 wherein the secondary member is releasably held within the bottom edge of the spray can by a friction fit therewith.

3. The spray can system of claim 1 wherein the secondary member has a recess therein in which the bottom edge of the spray can is releasably held.

4. The spray can system of claim 1 further comprising a ring for encircling part of the spray can for mounting the tube holder to the spray can, an interconnection member having a first end and a second end, the first end connected to or formed integrally with the ring, a holding member for holding the hollow spray tube and connected to or formed integrally with the second end of the interconnection member, and the tube holder part of the cap and the tube holder separable from the cap.

5. The spray can system of claim 4 wherein the ring is made of flexible stretchable material.

6. A spray can system comprising a spray can with a hollow body with contents therein and gas under pressure for expelling the contents therefrom, and nozzle apparatus connected to the spray can and having a nozzle with a fluid flow channel therethrough with an exit port for the passage of the contents out from the spray can, a cap releasably emplaced on the hollow body for covering the nozzle apparatus, and a tube holder for holding a spray tube insertable into the nozzle, the tube holder part of the cap and the tubeholder separable from the cap, and the cap including a sub-cap separable from the cap for releasably covering the nozzle apparatus following separation of the tube holder from the cap.

7. The spray can system of claim 6 further comprising the tube holder, the tube holder further comprising a ring for encircling part of the spray can for mounting the tube holder to the spray can, an interconnection member having a first end and a second end, the first end connected to or formed integrally with the ring, and a holding member for holding the hollow spray tube and connected to or formed integrally with the second end of the interconnection member.

8. The spray can system of claim 7 wherein the ring is made of flexible stretchable material.

9. The spray can system of claim 6 wherein the tube holder is separable from a top of the cap.

10. The spray can system of claim 6 wherein the tube holder is separable from an interior portion of the cap.

11. The spray can system of claim 6 wherein the cap has a lower edge and the tube holder is initially releasably connected to the lower edge of the cap.

12. A spray can system comprising a spray can with a hollow body with contents therein and gas under pressure for expelling the contents therefrom, and nozzle apparatus connected to the spray can and having a nozzle with a fluid flow channel therethrough with an exit port for the passage of the contents out from the spray can, a cap releasably emplaced on the hollow body for covering the nozzle apparatus, and a tube holder for holding a spray tube insertable into the nozzle, the tube holder part of the cap and the tube holder separable from the cap, the tube holder on a secondary member and separable therefrom and the secondary member releasably connected to the cap.

* * * * *